US005957598A

United States Patent [19]

Berkers et al.

[11] Patent Number: 5,957,598

[45] Date of Patent: Sep. 28, 1999

[54] PRINTING DEVICE WITH AN ALIGNING STATION FOR PRINTING ALIGNED RECEIVING SHEETS ON BOTH SIDES

[75] Inventors: Jacobus Arnoldus Peter Berkers, Koningslust; Lodewijk Tarcisius Holtman, Venlo; Andreas Theodorus Heijnen, Tegelen; Martinus Peter Hendrikus Hermans, Maasbree, all of Netherlands

[73] Assignee: OCE-Technologies, B.V., Venlo, Netherlands

[21] Appl. No.: 08/897,153

[22] Filed: Jul. 18, 1997

[30] Foreign Application Priority Data

Jul. 18, 1996 [NL] Netherlands ..... 1003631

[51] Int. Cl.[6] ..... B41J 13/26

[52] U.S. Cl. ..... 400/630; 271/250; 400/579; 101/231; 101/485

[58] Field of Search ..... 400/579, 605, 400/607.1, 630, 631, 633, 633.2, 709; 271/186, 250, 251, 252, 301, 902; 355/23, 24; 101/232, 233, 225, 231, 485

[56] References Cited

U.S. PATENT DOCUMENTS

| | | | |
|---|---|---|---|
| 4,453,841 | 6/1984 | Bobick et al. | 400/126 |
| 4,884,794 | 12/1989 | Dinatale et al. | 271/3 |
| 5,048,817 | 9/1991 | Roller | 271/250 |
| 5,088,848 | 2/1992 | DeFalco et al. | 400/630 |
| 5,577,719 | 11/1996 | Nicoll | 271/250 |
| 5,624,111 | 4/1997 | Maass | 271/250 |
| 5,697,608 | 12/1997 | Castelli et al. | 271/228 |

FOREIGN PATENT DOCUMENTS

| | | | |
|---|---|---|---|
| 61-241177 | 10/1986 | Japan | 400/630 |
| 5-169743 | 7/1993 | Japan | 400/579 |
| 1541796 | 3/1979 | United Kingdom . | |

OTHER PUBLICATIONS

IBM Technical Disclosure Bulletin, Vo. 31, No. 1, Jun. 1988, "Paper Aligner Mechanism".

"Device for Paper Length Measurement" (disclosed anonymously No. 35051) Research Disclosure Jun. 1993, p. 397.

*Primary Examiner*—Christopher A. Bennett

*Attorney, Agent, or Firm*—Birch, Stewart, Kolasch & Birch, LLP

[57] ABSTRACT

A printing device for duplex printing of a sheet, comprising a feed path for feeding an unprinted sheet and a return path for returning a sheet printed on one side in an inverted orientation to a part of the feed path which is provided with an aligning station for aligning a supplied unprinted sheet and a returned sheet printed on one side. The aligning station comprises two aligning mechanisms which are disposed in spaced relationship in the feed direction and which each comprise two activatable transport nips which, as considered in a direction transversely of the feed direction, are situated a short distance apart so that a sheet fed between the nips can be aligned against one of each of the two transport nips by lateral transport and turning.

20 Claims, 7 Drawing Sheets

PRINTING DEVICE WITH AN ALIGNING STATION FOR PRINTING ALIGNED RECEIVING SHEETS ON BOTH SIDES

FIELD OF THE INVENTION

The invention relates to a printing device having an aligning station for printing images on both sides of aligned receiving sheets, comprising: a printing unit for printing an image on a receiving sheet, a feed path for feeding a receiving sheet to the printing unit, a discharge path for discharging a receiving sheet printed in the printing unit, a return path between the discharge path and the feed path for returning a receiving sheet deflected from the discharge path to the feed path with inversion of the receiving sheet, and an aligning station for aligning a receiving sheet to be fed to the printing unit.

DESCRIPTION OF THE INVENTION

A printing device of this kind is known from U.S. Pat. No. 4,453,841, which describes a printing device with an aligning station which is situated in a part of the feed path which is located between the printing unit and the place where the return path leads into the feed path. Before a receiving sheet is returned in the feed path, it is stopped in a part of the return path and taken away in the reverse direction in order to invert the receiving sheet. In the aligning station used in this known printing device, a receiving sheet for alignment is moved in the transverse direction during forward transport of the receiving sheet so that the receiving sheet can be correctly aligned in the printing unit.

A disadvantage of this known printing device is that for alignment of a receiving sheet during forward transport thereof, the aligning station must extend over a considerable distance in the forward transport direction in order to allow an obliquely directed sheet transport. This distance is all the greater, the greater the skew position to be corrected.

SUMMARY OF THE INVENTION

The object of the present invention is to provide a printing device with an aligning station situated in that part of the return path where the direction of advance of a sheet returned in the feed path is reversed for the sheet inversion with the feed path leading into the part.

As a result, alignment of a receiving sheet takes place in the period when the receiving sheet is stationary during reversal of the direction of advance, so that no extra path length for alignment is required needing obliquely forwardly directed transport. Instead, it is possible to use the place and time during which the receiving sheet is stationary for its reversal. Preferably, the aligning station is formed by two aligning mechanisms, which are situated a distance apart in the direction of advance of a receiving sheet and which in co-operation with one another can displace a receiving sheet in a direction transversely of the direction of advance of the receiving sheet to a position in which the receiving sheet is aligned.

Consequently, each supplied receiving sheet, i.e. both a blank receiving sheet fed for the first time, and a returned receiving sheet printed on one side, are fed in the printing unit with the same side edge situated in the same position. The images to be applied occupy the same position with respect to the side edge, thus providing exactly opposite images particularly in the case of a duplex printed receiving sheet.

Another effect is that no retractable stop extending transversely over the transport path is required for aligning a receiving sheet, so that the receiving sheet can be rapidly removed after alignment.

In one attractive embodiment of a printing device according to the invention, each of the two aligning mechanisms is formed by first and second transport nips which are formed by transport roller pairs and which extend parallel to the direction of advance of the receiving sheet. The first transport nips are situated in a line coinciding with the position of a side edge of an aligned receiving sheet and which second transport nips are situated at short distances from the line within the transport path of the receiving sheet. The transport roller pairs forming the first and second transport nips are releasable for feeding a receiving sheet between the transport rollers unobstructedly and in a nip-forming condition are drivable in opposite directions to one another in order to align the receiving sheet along the line.

Consequently, a side edge of a receiving sheet for alignment can lie on either side of the line along which the receiving sheet is aligned.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
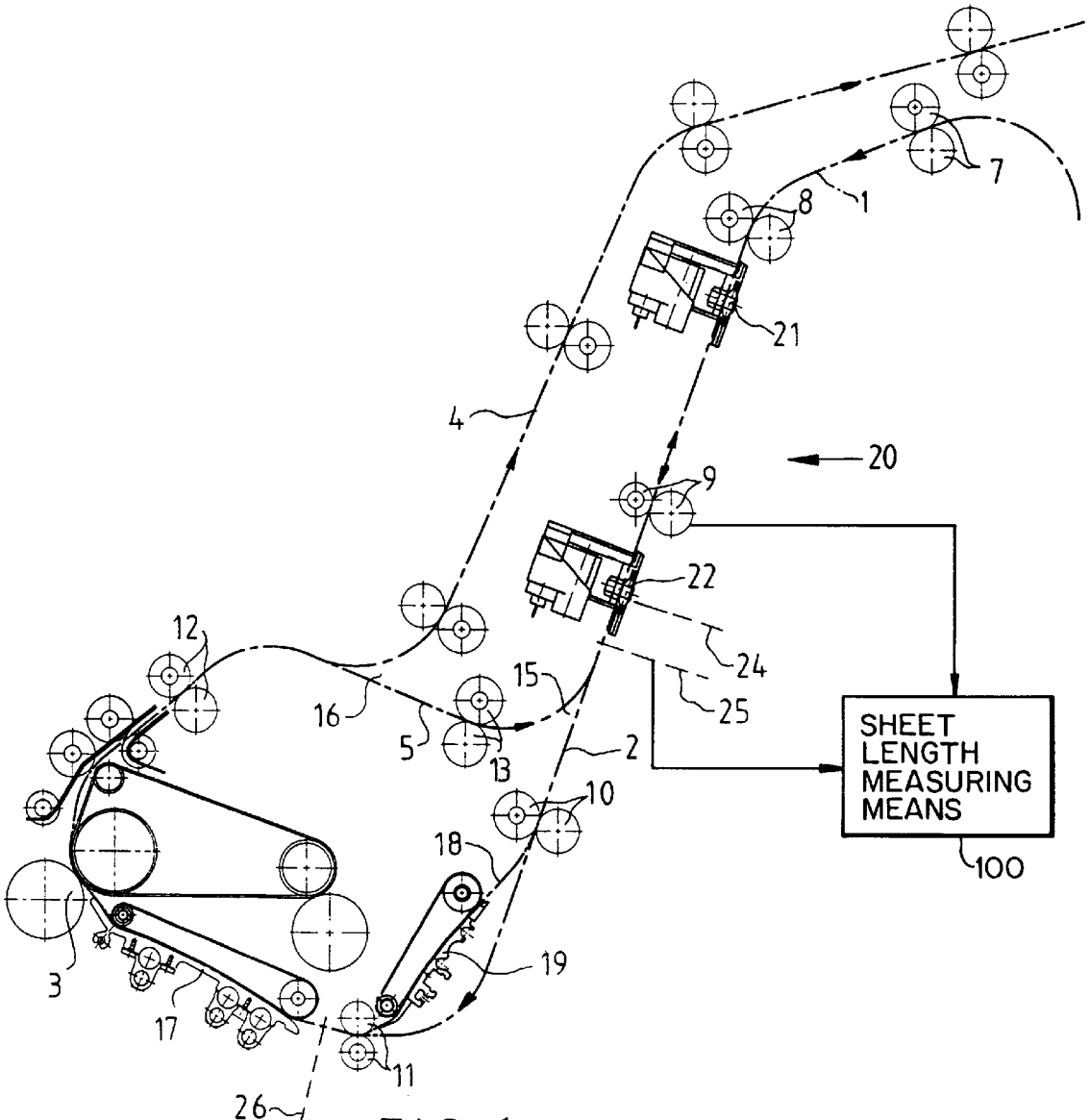
FIG. 1 shows part of a printing device having the aligning station according to the invention.

The part of a printing device shown in FIG. 1 illustrates a transport path system for transporting sheets of receiving material through the printing device. The transport path system comprises:

- a feed path 1 for feeding sheets for printing from a stock magazine (not shown),
- a transit path 2 adjoining the feed path 1 and leading through an image transfer station 3 where the sheets are printed, a discharge path 4 adjoining the transit path 2 for discharging sheets passed through the transit path 2 to a finishing station (not shown), e.g. a station for collecting and binding a set of printed receiving sheets, and a return path 5 also adjoining the transit path 2 and leading into the feed path 1 to return to the feed path 1 a receiving sheet printed on one side in the image transfer station 3, so that the sheet may again be fed, but in an inverted position, through the image transfer station 3 in order to print the other side of the sheet.

As shown in FIG. 1, the feed path 1, the transit path 2 and the return path 5 are provided with regularly spaced pairs of transport rollers 7 to 13, which pairs form transport nips for feeding receiving sheets always with positive engagement by the transport path system. When A4 sheets are fed transversely, the nip distance, with the image transfer nip also serving as a transport nip, is less than 210 mm for that purpose.

The place 15 where the feed path 1, transit path 2 and return path 5 meet is so shaped that a sheet coming from the feed path 1 arrives at the transit path 2 and a sheet coming from the return path 5 arrives at the feed path 1, e.g. by means of a suitable diverter at location 15 to ensure that a sheet which has been supplied does not reach the return path 5 directly and a returned sheet is fed to the feed path 1 in the opposite direction to the feed direction.

At the place 16 where the return path 5 and the discharge path 4 adjoin the transit path 2, a diverter (not shown) is provided so that a sheet on leaving the transit path 2 can be fed selectively to the discharge path 4 or to the return path 5.

In order to transfer and melt a powder image in the image transfer station 3 under the influence of heat, the transit path 2 just in front of the image transfer station 3 contains a heating device 17 for preheating receiving sheets. A transport path 18 is formed parallel to the transit path 2 between the pairs of transport rollers 10 and 11 and is disposed before the image transfer station 3. The parallel transport path 18 is provided with an extra heating device 19 for extra preheating of receiving sheets coming directly from the sheet magazine. Returned sheets which are passed through the machine for the second time are passed through outside the heating device 19 in order to prevent excessive heating. The transport path 18 is accessible by means of a diverter (not shown) at the start of path 18.

That part of the feed path 1 which is situated directly upstream of location 15 is arranged as an alignment station 20. For this purpose, the part is in the form of a straight downwardly sloping path in which pairs of transport rollers 8 and 9 are situated. Directly downstream of the pair of transport rollers 8, a first aligning mechanism 21 is disposed and directly downstream of the pair of transport rollers 9, a second alignment mechanism 22 is provided.

To control the transit of a receiving sheet through the transport path system shown in FIG. 1, a number of sensors 24 and 25 are also provided in that part of the feed path 1 which forms the aligning station 20, in order to detect the sheet leading edge at the places illustrated.

A sensor 26 is also disposed between the pair of transport rollers 11 and the sheet heating device 17 to detect the sheet leading edge there.

Before describing the action of the aligning station 20 in detail, the timing of the sheet transport by the device shown in FIG. 1 will first be described with reference to the speed graph shown in FIG. 2 in respect of three sheets fed successively through the device. With regard to the action of the aligning station 20, it will be sufficient to indicate here that a receiving sheet is stationary during alignment in the downstream last part of the feed path 1.

It will be clear that part of the transit path 2 which extends from the junction 15 to the image transfer station 3 can be regarded as part of the sheet feed path, and that part of the transit path 2 which extends from the image transfer station 3 to the junction 16 can be regarded as a part of the sheet discharge path, so the return path 5 connects the sheet feed path and the sheet discharge path.

Figure 2:
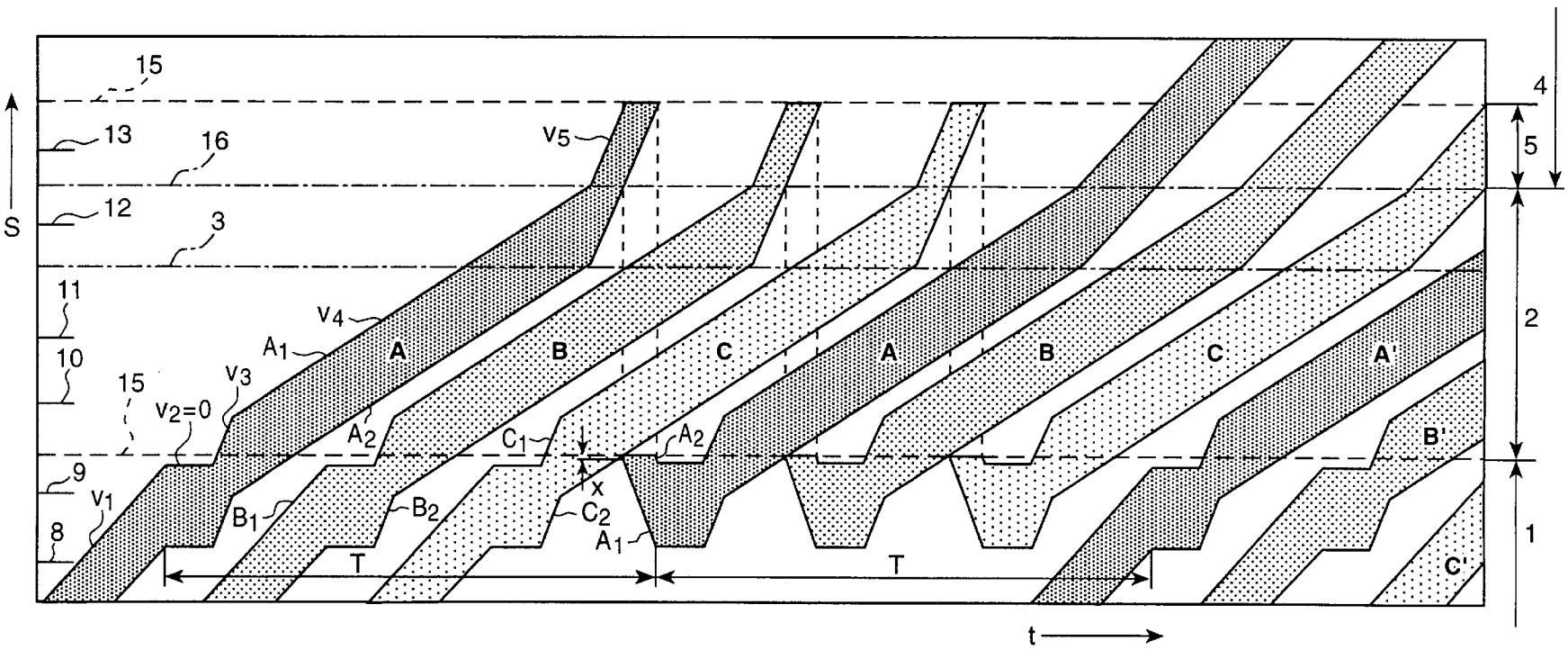
FIG. 2 is a graph showing the speed of a receiving sheet on transit through the part shown in FIG. 1.

FIG. 2 is a graph showing the speed of consecutively supplied receiving sheets A, B and C on passage through the transport path system shown in FIG. 1, the path distances S being shown on the vertical axis and the time t plotted along the horizontal axis.

The first receiving sheet A is fed by the pairs of transport rollers 7, 8 and 9 at a speed $V_1$, the magnitude of which is illustrated in FIG. 2 by the angle of inclination of the leading edge and the trailing edge of the sheets denoted by lines $A_1$ and $A_2$ respectively.

When the leading sheet edge $A_1$ is detected by sensor 24, the pair of transport rollers is braked to stop the receiving sheet A ($V_2$=0). For a short period during which it is stationary, the receiving sheet A is aligned in a manner to be explained hereinafter.

After expiry of the short period, e.g. 200 ms, the drive to the pair of transport rollers 9 is restored, the speed of transport of the pair 9 having a value $V_3>V_1$ in order that the aligned receiving sheet may be fed with acceleration from the aligning station 20 towards the pair of transport rollers 10. The speed of transport of the pairs of transport rollers 7 and 8 remains at a value $V_1$, because during the aligning the receiving sheet A has already left the pairs of transport rollers 7 and 8.

Just before the leading edge $A_1$ of receiving sheet A reaches the pair of transport rollers 10, the speed of transport $V_3$ of the pair 9 of transport rollers is returned to transport speed $V_4$ which corresponds to the speed with which an image is fed through the image transfer station 3 and with which the receiving sheet A is transported by the pairs of transport rollers 10, 11 and 12. Transport roller pair 11 acts as a synchronization nip in these circumstances. When the leading edge $A_1$ of receiving sheet A activates sensor 26 disposed directly downstream of the transport roller pair 11, a control device (not shown) compares the time required by the receiving sheet A to reach the image transfer station 3 on transport at speed $V_4$ (the sheet time) with the time that the image still requires to reach the image transfer station 3 on transport at the process speed (image time). When the sheet time is shorter than the image time, the speed of transport of the transport roller pair 11 is temporarily so reduced that receiving sheet A arrives at the image transfer station 3 simultaneously with the image. When the sheet time is longer than the image time, the transport speed of transport roller pair 11 is temporarily increased so that in this case too, the sheet arrives at the image transfer station 3 simultaneously with the image.

It should be noted that these variations of the speed $V_4$ are as a rule so small that no obstruction is experienced from a preceding or following receiving sheet fed at a reduced or increased speed $V_4$. This can be taken into account in selecting the distance between which the receiving sheets are supplied. When the trailing edge $A_2$ of the receiving sheet A has left the image transfer station 3, the leading edge $A_1$ of the receiving sheet A has arrived just in front of the junction 16. When the receiving sheet A is only to be printed on one side, the control device (not shown) has set a diverter at the junction 16 to a position in which the receiving sheet A is fed into the discharge path 4 at transport speed $V_4$. If, however, the receiving sheet A is also to be printed on the other side, the diverter is brought to a position in which the receiving sheet A is fed in the return path 5 and the transport speed of the transport roller pairs 12 and 13 is set to a value $V_5>V_4$ so that receiving sheet A can be returned at an accelerated speed as will be seen in FIG. 2. During this return, the receiving sheet A is deflected in the direction of the feed path 1 and fed therein in the upstream direction, i.e. in the opposite direction to the downstream direction in which the receiving sheet A was originally fed through the feed path 1. At the opening of the return path 5 into the feed path 1, a flexible flap projecting freely upwards closes off the return path 5 for the unobstructed feed of a receiving sheet from the feed path 1 into the transit path 2, without such sheet being able to pass from the feed path 1 into the return path 5. A returned receiving sheet presses the flexible flap aside so that a receiving sheet fed in the return path 5 can be fed back into the feed path 1.

The upstream movement of receiving sheet A through the feed path 1 is shown in FIG. 2 by the mirror-image illustration of the speed lines for the sheet edges $A_1$ and $A_2$ when the leading edge $A_1$ of a returned receiving sheet has reached the transition 15 between the return path 5 and the downstream end of the feed path 1. When a returned receiving sheet reaches the aligning position, the drive for the pair of transport rollers 9 is braked and stopped for a short period, in which an aligning movement again takes place. The re-aligned receiving sheet A is then fed through the transit path 2 for the second time so that just as in the case of the first passage, it can be provided with an image at the required location on the side thereof which as yet has no image. The receiving sheet printed on both sides is then fed to the discharge path 4 via the deflected diverter at the junction 16. The time between reaching the aligning position in the aligning station 20 for the first time and for the second time is the cycle time T of the inverting path formed by the transport path system.

Following receiving sheets B and C are fed through the inverting path in a manner corresponding to the manner in which receiving sheet A was taken through the inverting path, as shown graphically in FIG. 2.

As shown in FIG. 2 also, the trailing sheet edge $C_2$ of the third receiving sheet C is still in the feed path 1 when the leading edge $A_1$ of the returned receiving sheet A reaches the junction 15. This overlap, however, must not be so great that there is no time left to reverse the direction of movement of the transport roller pair 9 between the time that the trailing sheet edge $C_2$ is out of the associated transport nip and the leading sheet edge $A_1$ is at the transport nip.

It will be apparent that instead of three short receiving sheets A, B and C the same transport path system can also be arranged for two longer receiving sheet with timing adapted thereto.

If a speed regulation system is used for the transport roller pair 11 forming a synchronization nip, for the purpose of synchronization of the arrival of a receiving sheet and an image for transfer thereto in the image transfer station 3 (hereinafter referred to as registration in the transit direction=X-direction), no transport nip has to be stopped in order to serve as a stop nip for registration of the receiving sheet in the X-direction or otherwise stop the receiving sheet against a retractable stop.

For the above-described registration in the X-direction, only the leading edge of the receiving sheet has to be accurately detected at a fixed location (by sensor 26), and there should be no slip in the synchronization nip formed by transport roller pair 11 just before sensor 26, so that the receiving sheet can arrive simultaneously with the image in the image transfer station by deceleration or acceleration of the receiving sheet in the synchronization nip.

During transport of receiving sheets through the feed path 1, the transit path 2 and the return path 5, a shift in the passage of the receiving sheets may occur in a direction transversely of a transit direction, the transverse direction hereinafter being referred to as the Z-direction. A shift of this kind in the Z-direction (due inter alia to tolerances in respect of the correct position of transport and guide means, particularly skewing, incorrect settings and wear) leads to deviations such that an image for transfer to the receiving sheet is no longer situated on the receiving sheet in the required position. For example, the image may be too far from an edge of the receiving sheet parallel to the X-direction, or too close to the edge, or even outside the receiving sheet, resulting in loss of information. In the event of the receiving sheet being skewed as it passes through the image transfer station, the image itself will be skewed on the receiving sheet. The aligning station to be described hereinafter is capable of aligning a skewed receiving sheet by rotating it about a point in the X-Z plane, such rotation hereinafter being referred to as turning.

The positioning device shown in FIG. 1 for positioning a receiving sheet in the Z-direction (Z-registration) and aligning a skewed receiving sheet by turning, will now be described.

The combining of Z-registration and alignment at the place where a receiving sheet to be printed on both sides is stopped before reversion and integration thereof into the sheet feed path has the advantage of saving time in the timing of the receiving sheets, so that a relatively low sheet transport speed can be used.

The positioning device is adapted to position before entering the image transfer station 3 one of the long sides of a receiving sheet extending in the X-direction, in order that the same may be positioned on the ideal transport line for the long side so that in the case of a rectangular receiving sheet the leading edge of the receiving sheet is also in the correct position.

The aligning station 20 comprises two aligning mechanisms 21 and 22 which, as considered in the X-direction, are disposed a distance apart somewhat smaller than the minimal length of a receiving sheet for alignment, e.g. at a distance of 180 mm for aligning a transversely fed A4-sheet 210 mm long in the X-direction. A receiving sheet for alignment fed directly from a sheet magazine is slowed down and stopped after detection of its leading edge by the sensor 24 and a receiving sheet for re-alignment coming from the return path 5 is slowed down and stopped after detection of its trailing edge by sensor 25. In both cases the receiving sheet stops when the detected sheet edge, as considered in the X-direction, is situated centrally between the sensors 24 and 25. Both aligning mechanisms 21 and 22 are of identical construction and are situated near a side edge of a receiving sheet which is to be fed through the machine.

As shown in FIGS. 3A, 3B, 3C, 4A, 4B and 4C, aligning mechanism 21 comprises a first positioning roller pair 31 and aligning mechanism 22 a first positioning roller pair 32, which roller pairs 31 and 32 each form a nip which extends along a straight line 33 in the X-direction which line coincides with a side edge of an aligned receiving sheet. A second positioning roller pair 34 is disposed some distance from roller pair 31 within the sheet transport path and a second positioning roller pair 35 is disposed at some distance from roller pair 32 again within the sheet transport path. The bottom positioning rollers of each roller pair 31, 32, 34 and 35 are situated with their top edge in the sheet transport plane of the feed path 1.

The top positioning rollers of the pairs 31 and 34 are mounted in an arm 36 hingeable about a spindle 37 situated some distance above the sheet transport plane and at some distance outside the sheet transport through the feed path 1. The top positioning rollers of the pairs 32 and 35 are mounted in an arm 38 hingeable about a spindle 39 situated in extension of spindle 37. Drive means (not shown in FIGS. 3B, 3C, 4B and 4C) are fixed on the arms 36 and 38 and drive the top rollers of the pairs 31, 32, 34 and 35 in the directions indicated by arrows in FIGS. 3B and 3C, so that an inwardly directed transport force is applied in the nip between the outer pairs of rollers 31 and 32 and an outwardly directed transport force is applied in the nip between the innermost roller pairs 34 and 35, the outwardly directed transport force being less than the inwardly directed transport force. This latter effect is achieved by setting a lower value for the normal force with which the rollers of pairs 34 and 35 are pressed against one another than the normal force with which the rollers of pairs 31 and 32 are pressed against one another. It can also be achieved by coating the rollers of pairs 34 and 35 with a material having a lower coefficient of friction than the covering of the pairs of rollers 31 and 32.

Figure 3A:
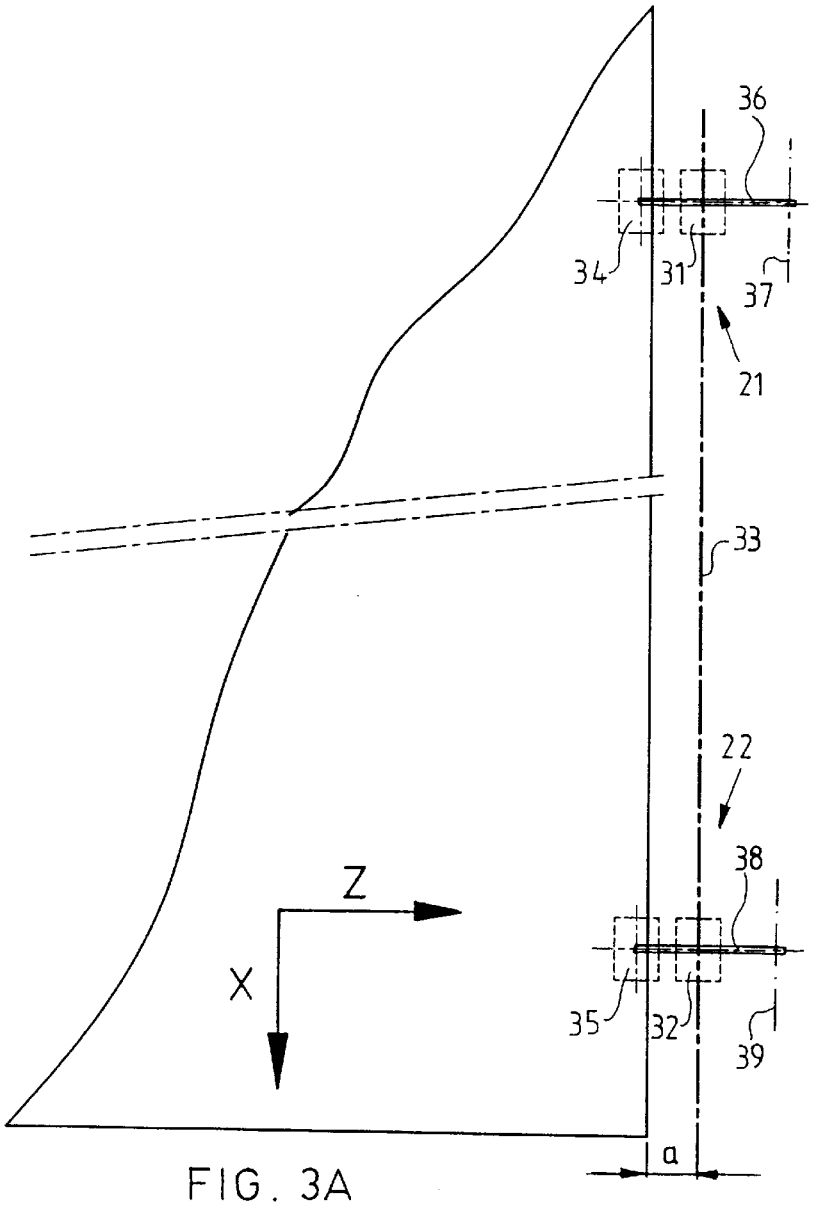
FIGS. 3A, 3B and 3C show the alignment of a receiving sheet supplied in a shifted orientation in a first direction.
Figure 3B:
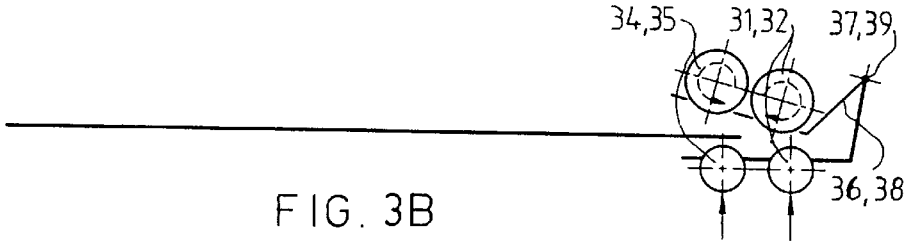
Figure 3C:
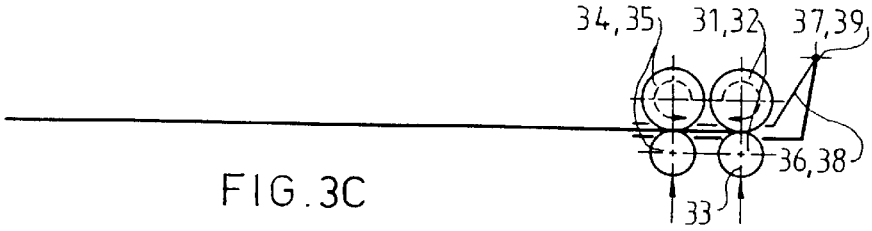
Figure 4A:
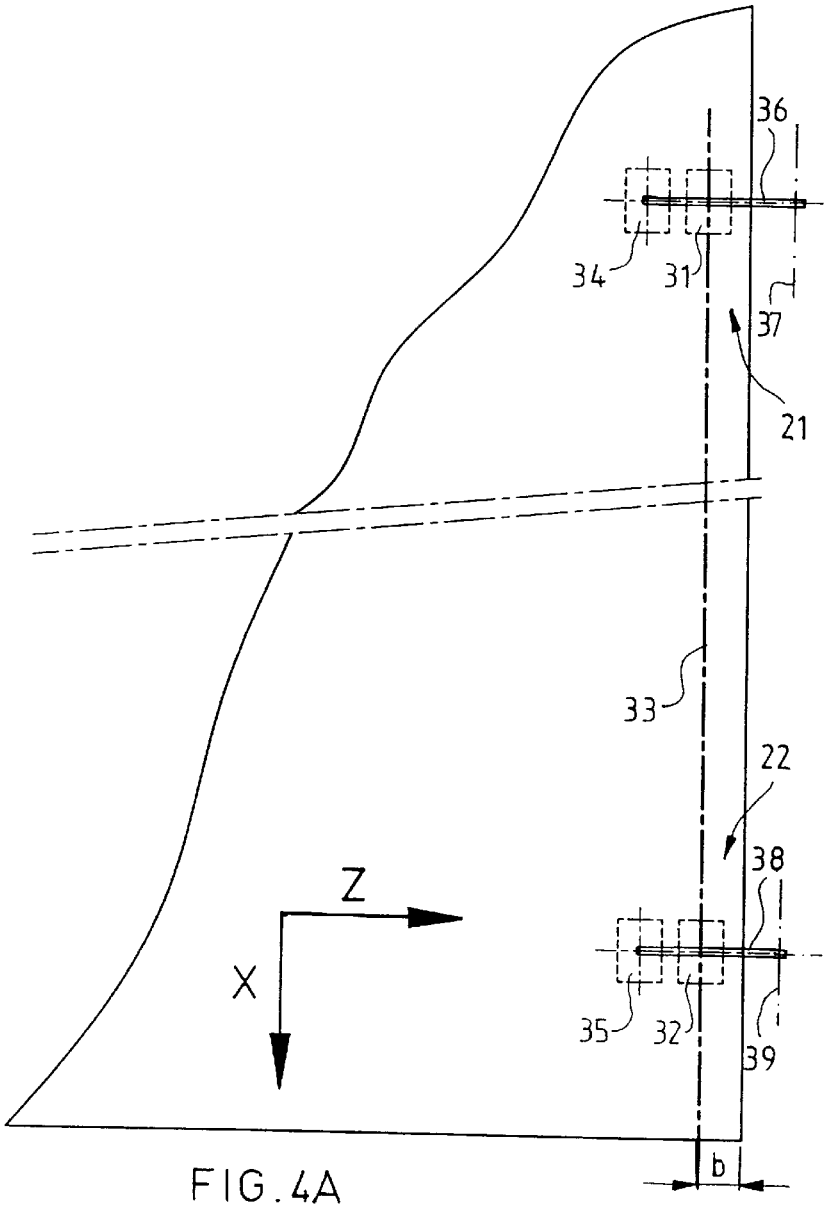
FIGS. 4A, 4B and 4C show the alignment of a receiving sheet supplied in a shifted orientation opposed to the first direction.
Figure 4B:
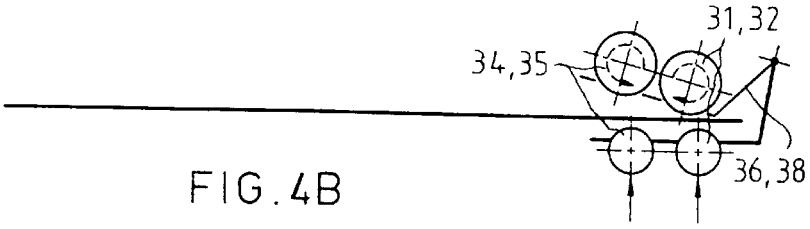
Figure 4C:
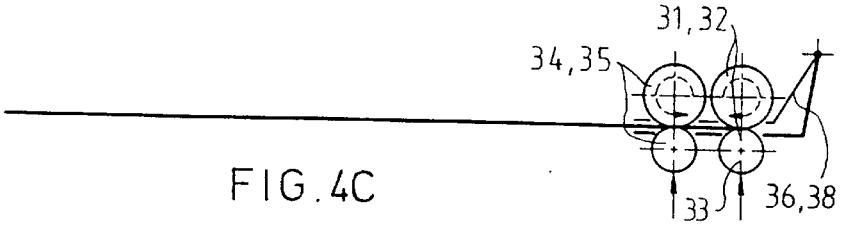

By turning the arms 36 and 38 about the spindles 37 and 39, the pairs of rollers 31, 32, 34, 35 can be moved from the open position shown in FIGS. 3B and 4B to the closed position shown in FIGS. 3C and 4C.

FIG. 3A is a top plan view of the aligning station 20 with a supplied receiving sheet which has shifted to the left with respect to the line 33 over the distance a. As shown in FIG. 3B, this supply takes place with the positioning roller pairs 31, 34 and 32, 35 open. After stoppage of the supplied receiving sheet, the positioning roller pairs are closed by actuation of a solenoid (not shown), which turns the arms 36 and 38. Directly after the closing of the positioning nips, the transport roller 9 is lifted or at least the nip force is reduced to an extent such that the sheet can move freely in this transport nip, particularly in the Z-direction. In the case of a long sheet, the lifting of the nip force also applies to transport rollers 8.

The receiving sheet for positioning is now shifted in the direction of line 33 by the positioning roller pairs 34 and 35. Since this line 33 extends along the nip of the positioning roller pairs 31 and 32, the receiving sheet will be arrested there by the positioning roller pairs 31 and 32 rotating in opposite directions, and the positioning rollers 34 and 35 will slip with respect to the positioned receiving sheet, this situation being shown in FIG. 3C.

FIG. 4A is a top plan view of the aligning station 20 with a supplied receiving sheet which is shifted to the right with respect to the line 33 over a distance b so that the receiving sheet is situated between all the open positioning nips, as shown in FIG. 4B. After the successive closure of the positioning nips and the lifting of the transport nips between which the receiving sheet is situated, the receiving sheet is transported by the positioning roller pairs 31 and 32 in the direction of line 33, the positioning rollers of the pairs 34 and 35 slipping with respect to an edge portion of the receiving sheet. When the receiving sheet side edge is released by the positioning roller pairs 31 and 32, the positioning roller pairs 34 and 35 hold the receiving sheet pressed against the nips of the positioning roller pairs 31 and 32, this situation being shown in FIG. 4C.

The use of two aligning mechanisms 21 and 22 offers the possibility of aligning an A3 sheet supplied in the longitudinal direction, which during positioning between lifted transport roller pairs 8 and 9 is situated with a bend therebetween. If only one positioning roller mechanism were used, the positioning operation would experience excessive resistance.

Figure 5:
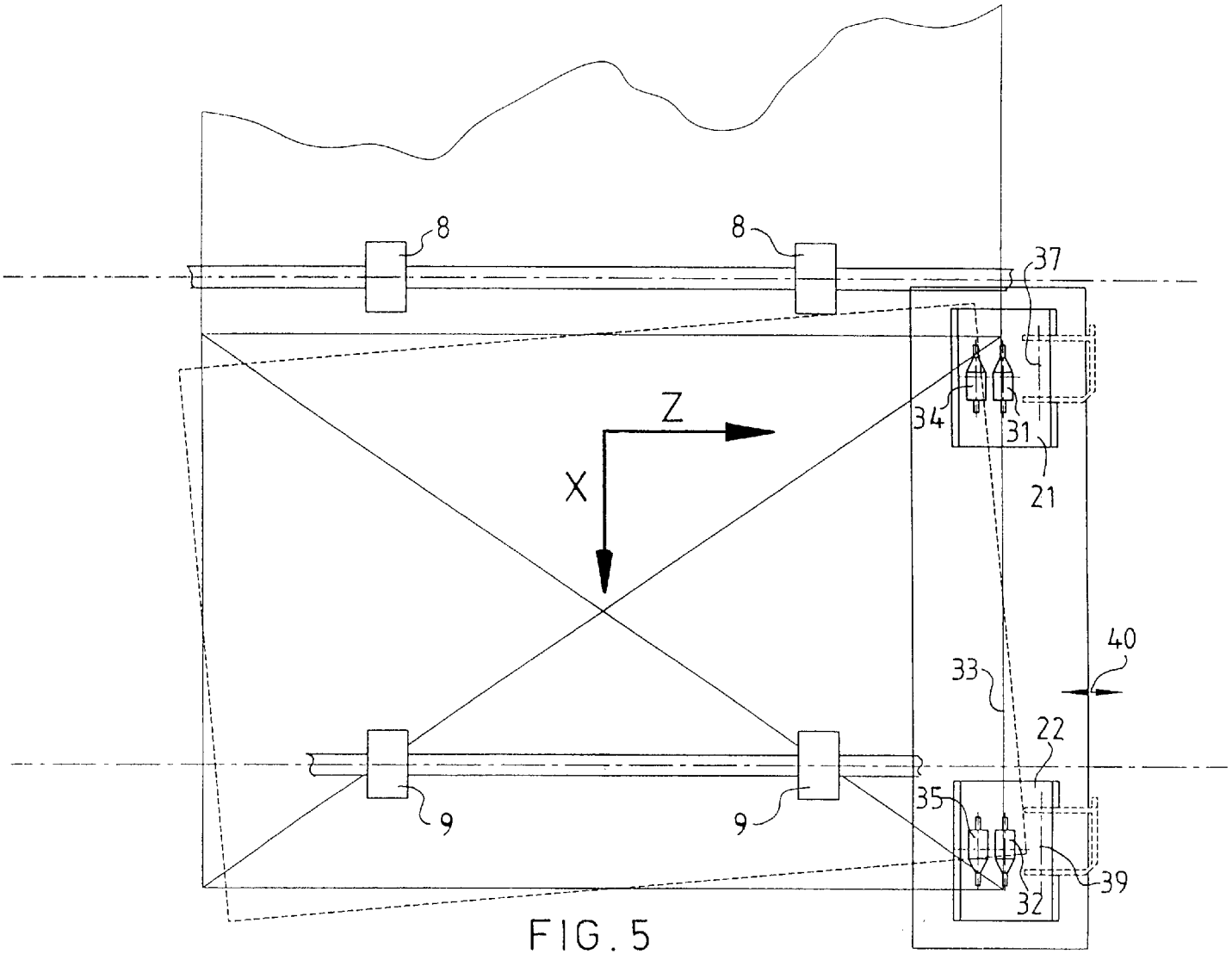
FIG. 5 is a top plan view of the aligned sheet with a skew and an aligned A4-sheet.

The broken lines in FIG. 5 show the situation in which a supplied A4 receiving sheet is in a skew position, the downstream part of a side edge of the sheet being situated between the open nips of both the positioning roller pair 35 and the positioning roller pair 32 and the upstream part of a side edge of the sheet is situated only between the open nip of positioning roller pair 34. On closure of the positioning roller pairs, roller pair 32 transports the sheet in the direction of roller pair 35 and roller pair 34 transports the sheet in the direction of roller pair 31, so that the sheet rotates until it is situated along line 33. In the case of a sheet supplied in a skew orientation in the other direction, roller pairs 31 and 35 perform the aligning function in the reverse direction.

Instead of releasing the transport roller nip 9 and, possibly, 8, after the positioning roller nips have closed, release can also be omitted and the positioning nips can be closed sooner with a gain in time if just the pressure application of the transport nip is removed and the rollers 9 thus press on one another solely by their own weight in order to retain the sheet firmly in the sloping path, so that during alignment only this slight contact pressure has to be overcome.

Experiment has shown that the above-described aligning station in which the speed of transport of the positioning roller pairs 31, 32, 34 and 35 is 275 mm/s enables a receiving sheet to be aligned over a distance up to a maximum of about 5 mm in 70 ms with an aligning accuracy of between 0.1 and 0.2 mm.

To align receiving sheets which have a different length in the Z-direction, the aligning mechanisms 21 and 22 can be mounted on a straight guide for displacement of the mechanisms 21 and 22 in the Z-direction indicated by arrows 40, until line 33 through the nips of the positioning roller pairs 31 and 32 is again on the required line along which a side edge of the receiving sheet must pass through the image transfer station 3.

Figure 6:
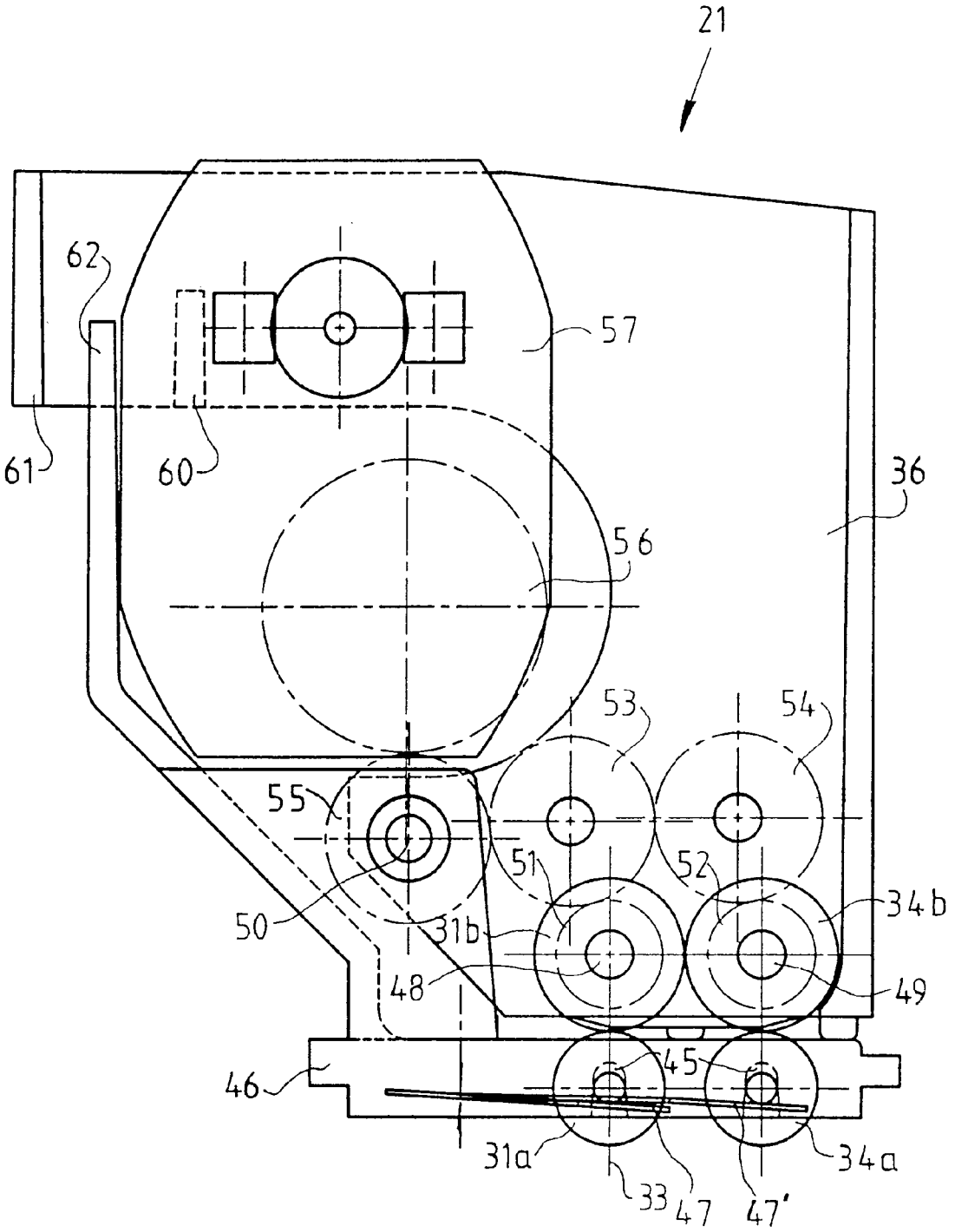
FIG. 6 is a side elevation of one of the two aligning mechanisms used according to the invention.

FIG. 6 shows a physical embodiment of the aligning mechanism 21 used according to the invention. The aligning mechanism 22 is of identical construction.

The bottom roller 31*a* of the positioning roller pair 31 and the bottom roller 34*a* of the positioning roller pair 34 are each mounted with their journals in slots 45 which extend vertically in a fixed frame 46. Leaf springs 47 and 47' press the journals towards the top of the slots 45. The leaf springs 47 for pressing up the roller 31*a* exert a greater force than the leaf springs 47' for pressing up the roller 34*a*, e.g. by means of a difference in leaf spring length as shown in FIG. 6.

The top rollers 31*b* and 34*b* of the positioning roller pairs 31 and 34 are each fixed on a spindle 48 and 49 respectively, which spindles 48 and 49 are rotatable in a sub-frame 36. Sub-frame 36, which forms the arm 36 shown in FIGS. 3 to 5, is fixed to the frame 46 so as to be hingeable about a spindle 50. Gearwheels 51 and 52 respectively are fixed on spindles 48 and 49 and co-operate with gearwheels 53 and 54 respectively. Gearwheel 53 also engages a gearwheel 54 and gearwheel 55 mounted about spindle 50. Gearwheel 55 in turn engages a gearwheel 56 drivable by means of a motor 57 fixed to frame 46. When driven by motor 57 the top positioning rollers 31*b* and 34*b* are driven in the directions indicated in FIGS. 3 and 4.

Two lips 60 and 61 are formed on the sub-frame 36 and extend on either side of a stop 62 formed on the frame 46.

A torsion spring disposed around spindle 50 presses sub-frame 36 into an open position in which lip 60 is in contact with stop 62 and the bottom and top positioning rollers are apart as shown in FIGS. 3B and 4B. Application of a solenoid (not shown) for pressing to lip 61 of the sub-frame 36 against the action of the torsion spring causes sub-frame 36 to turn about spindle 50 into the closed position of the positioning mechanism 21 shown in FIGS. 3C and 4C, in which closed position the top positioning rollers 31*b* and 34*b* press down the bottom positioning rollers 31*a* and 31*b* against the action of leaf springs 47 and 47', and wherein there is a greater nip force between the positioning rollers 31 than between the positioning rollers 34 because of the difference in pressure application force. As already stated, positioning mechanism 22 is of the same construction as the positioning mechanism 21 described hereinbefore.

Figure 7A:
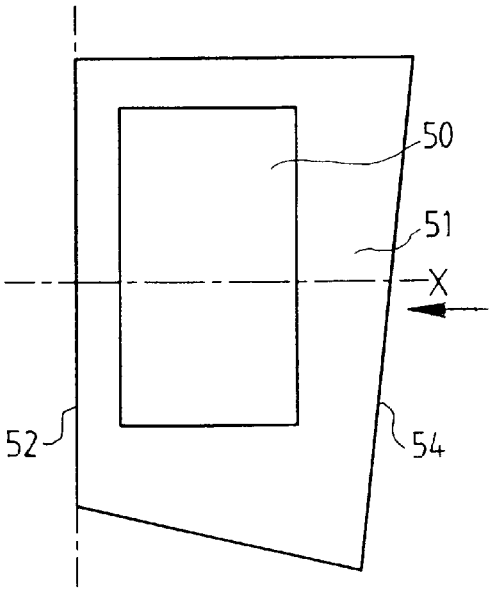
FIGS. 7A and 7B show a copy sheet which is aligned at its leading edge before printing of each side.
Figure 7B:
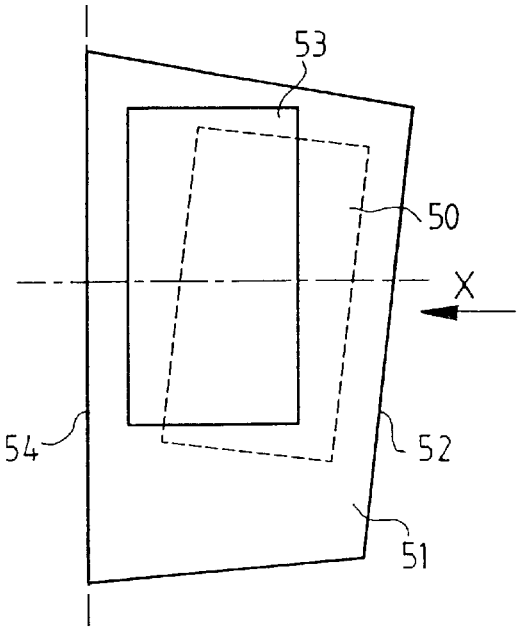

FIG. 7A shows the location of an image on transfer of an image 50 to the front of a receiving sheet of which the opposite sides are not exactly parallel and in the case in which the receiving sheet is aligned at its leading edge 52 in accordance with the prior art. In these conditions the image 50 will be situated parallel to the leading edge 52 on the front side of the receiving sheet 51. When the receiving sheet is provided with an image 53 on the reverse side, the image 53 will be parallel to the edge 54 opposite the edge 52 on the receiving sheet if the receiving sheet is aligned at the leading edge 54 of the inverted receiving sheet 51. As shown in FIG. 7B, the images 50 and 53 are skewed relatively to one another if the edges 52 and 54 are not exactly parallel.

Figure 8A:
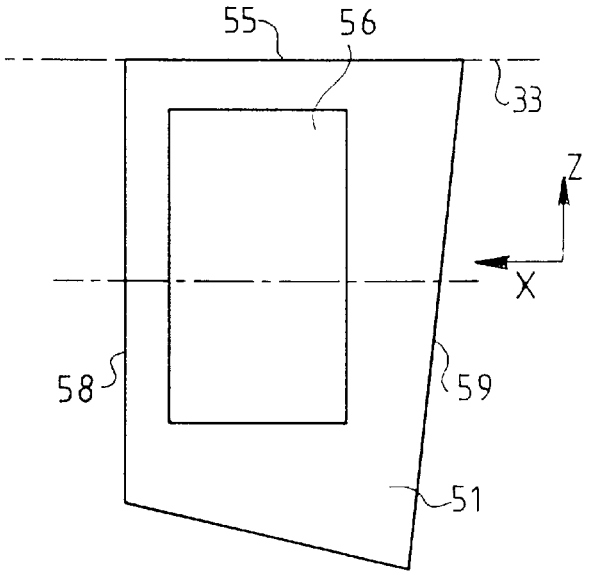
FIGS. 8A and 8B show a copy sheet which is aligned at a side edge before printing of each side according to the invention.
Figure 8B:
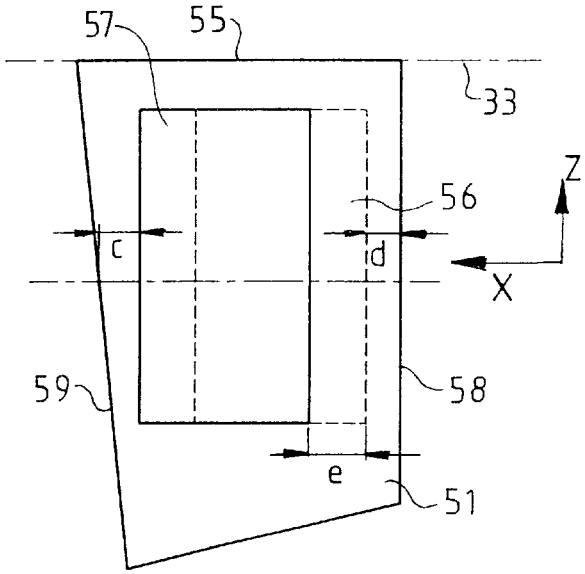

When the receiving sheet 51 is positioned at an edge 55 parallel to the X-direction, and when, in accordance with the present invention, this takes place both before the transfer of an image 56 to the front side of the receiving sheet 51 (FIG. 8A) and before the transfer of an image 57 to the back side of the receiving sheet 51 (FIG. 8B), on the same side edge 55, then the images 56 and 57 will not be located on the receiving sheet 51 in a skewed orientation.

On registration of images 56 and 57 in the X-direction, respectively relatively to the oppositely situated leading edge 58 and trailing edge 59 (distances c and d are the same in FIG. 8B), then in the event of deviations of the sheet length between the edges 58 and 59 relative to the nominal sheet length, e.g. a length of 210 mm in the case of A4, the images 56 and 57 can be shifted somewhat relative to one another in the X-direction. By measuring the sheet length on the basis of accurate detection of the leading and trailing sheet edges of a receiving material fed back in the aligning station 20, such measurement being carried out by sensor 25, and counting pulses derived from transport rollers 9 between two detections, it is possible to determine the exact sheet length such as with a sheet length measuring mean 100. On the basis of this sheet length as determined, the synchronization between the receiving sheet and the image to be transferred to the back side can be shifted over a distance e corresponding to the difference between the sheet length as determined and the nominal sheet length, so that the images are situated exactly opposite one another on the front and back sides. By taking into account the exactly measured sheet length, the X-registration in fact always takes place relatively to the originally leading edge, so that even format changes due to temperature and moisture changes in the receiving sheet do not, on repeated transit, have any influence on registration accuracy.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A printing device in which images are printable on both sides of aligned receiving sheets, comprising:

a printing unit for printing an image on a receiving sheet;

a feed path for feeding a receiving sheet to the printing unit;

a discharge path for discharging a receiving sheet from the printing unit;

a return path between the discharge path and the feed path for returning a receiving sheet from the discharge path to the feed path and for inverting a receiving sheet; and an aligning station for aligning a receiving sheet to be fed to the printing unit, the aligning station being situated in both the feed path and in a part of the return path where a sheet returned in the feed path has its direction of advance reversed.

2. The device according to claim 1, wherein the aligning station is formed by two aligning mechanisms, the two aligning mechanisms being situated a distance apart in a direction of advance of a receiving sheet, the two aligning mechanisms cooperate with one another for displacing a receiving sheet in a direction transversely of the direction of advance to an alignment position.

3. The device according to claim 2, wherein each of the two aligning mechanisms include a first transport nip formed by a first transport roller pair and a second transport nip formed by a second transport roller pair, the pairs of transport rollers extend generally parallel to the direction of advance of a receiving sheet, the first transport nips being situated along a line coinciding with a position of a side edge of an aligned receiving sheet, the second transport nips being spaced from said line and being within a transport path of a receiving sheet, means for releasing the pairs of transport rollers forming the first and second transport nips, a receiving sheet being fed upon release of the pairs of transport rollers between the transport rollers unobstructedly and being drivable in a nip-forming condition, each of the pairs of transport rollers being drivable in opposite directions to one another in the nip-forming condition to align a receiving sheet along said line.

4. The device according to claim 3, further comprising a spindle and an arm for each of the pairs of transport rollers, a top transport roller of each of the pair of transport rollers being fixed on the arm, each of the arms being rotatable about the spindle in order to open the associated transport nips, the spindles extend in the direction of advance and are above and spaced from the feed path, the first transport roller pair being between the spindle and the second transport roller pair for each of the aligning mechanisms.

5. The device according to claim 4, further comprising means for pressing the transport rollers of each second pair against one another with a force which is less than a force with which the transport rollers of each first transport roller pair are pressed against one another, to form a nip such that a receiving sheet can slip between the second transport roller pair while a receiving sheet is transported or retained by the first transport roller pair.

6. The device according to claim 4, further comprising sheet length measuring means in the aligning station for measuring a length of a returned and then aligned receiving sheet so that irrespective of a length of a receiving sheet, images are printable in the printing unit on both sides of a receiving sheet at equal distances from a same sheet edge extending transversely of the direction of advance.

7. The device according to claim 3, further comprising means for pressing the transport rollers of each second pair against one another with a force which is less than a force with which the transport rollers of each first transport roller pair are pressed against one another, to form a nip such that a receiving sheet can slip between the second transport roller pair while a receiving sheet is transported or retained by the first transport roller pair.

8. The device according to claim 3, further comprising sheet length measuring means in the aligning station for measuring a length of a returned and then aligned receiving sheet so that irrespective of a length of a receiving sheet, images are printable in the printing unit on both sides of a receiving sheet at equal distances from a same sheet edge extending transversely of the direction of advance.

9. The device according to claim 2, further comprising sheet length measuring means in the aligning station for measuring a length of a returned and then aligned receiving sheet so that irrespective of a length of a receiving sheet, images are printable in the printing unit on both sides of a receiving sheet at equal distances from a same sheet edge extending transversely of the direction of advance.

10. The device according to claim 1, further comprising sheet length measuring means in the aligning station for measuring a length of a returned and then aligned receiving sheet so that irrespective of a length of a receiving sheet, images are printable in the printing unit on both sides of a receiving sheet at equal distances from a same sheet edge extending transversely of the direction of advance.

11. A method for aligning receiving sheets in a printing device in which images are printable on both sides of an aligned receiving sheets, the method comprising the steps of:

feeding a receiving sheet from a feed path past a printing unit;

discharging the receiving sheet from the printing unit to a discharge path;

providing a return path between the discharge path and the feed path;

returning a receiving sheet deflected from the discharge path to the feed path, the receiving sheet being inverted during the returning;

aligning the receiving sheet in an aligning station which is in a part of the return path and the feed path;

feeding the sheet from the aligning station to the printing unit a direction of advance of the receiving sheet being reversed after the step of aligning.

12. The method for aligning receiving sheets according to claim 11, wherein the step of aligning comprises the step of linearly moving the receiving sheet in a direction generally transverse to the direction of advance of the receiving sheet.

13. The method for aligning receiving sheets according to claim 11, wherein the step of aligning comprises the step of rotating the receiving sheet to align an edge of the sheet with an alignment position.

14. The method for aligning receiving sheets according to claim 11, wherein the step of aligning comprises the steps of:

linearly moving the receiving sheet in a direction generally transverse to the direction of advance of the receiving sheet; and rotating the receiving sheet, whereby an edge of the sheet is aligned with an alignment position.

15. The method for aligning receiving sheets according to claim 11, wherein two aligning mechanism are provided for the aligning station, each of the aligning mechanism having at least two pairs of transport rollers, a first pair of transport rollers of each aligning mechanism being in a position coinciding with a side edge of an aligned receiving sheet and a second pair of the transport rollers being positioned within the transport path of the receiving sheet, the step of aligning further comprising the steps of:

releasing and holding the receiving sheet with both of the first and second pairs of transport rollers; and rotating each of the transport rollers in a pair in opposite directions in order to move the receiving sheet when the receiving sheet is being held.

16. The method for aligning receiving sheets according to claim 15, wherein the step of releasing and holding includes the step of pivoting the transport rollers of each pair toward and away from one another.

17. The method for aligning receiving sheets according to claim 15, further comprising the step of applying less force against the receiving sheet with the second pairs of transport rollers than the first pairs of transport rollers such that the receiving sheet slips in a nip formed between the second pairs of transport rollers.

18. The method for aligning receiving sheets according to claim 17, further comprising the steps of:

measuring a length of a receiving sheet fed to the aligning station from the printing unit; and using the measured length to position the receiving sheet so that irrespective of the length of the receiving sheet, images are printable in the printing unit on both sides of the receiving sheet at equal distances from a same sheet edge extending transversely of the direction of advance.

19. The method for aligning receiving sheets according to claim 15, further comprising the steps of:

measuring a length of a receiving sheet fed to the aligning station from the printing unit; and using the measured length to position the receiving sheet so that irrespective of the length of the receiving sheet, images are printable in the printing unit on both sides of the receiving sheet at equal distances from a same sheet edge extending transversely of the direction of advance.

20. The method for aligning receiving sheets according to claim 11, further comprising the steps of:

measuring a length of a receiving sheet fed to the aligning station from the printing unit; and using the measured length to position the receiving sheet so that irrespective of the length of the receiving sheet, images are printable in the printing unit on both sides of the receiving sheet at equal distances from a same sheet edge extending transversely of the direction of advance.

* * * * *